US007213949B2

(12) United States Patent
Ford et al.

(10) Patent No.: US 7,213,949 B2
(45) Date of Patent: May 8, 2007

(54) FOUR SEGMENT REFLECTOR

(75) Inventors: Paul R. Ford, Orange, CT (US); Carl R. Lueck, Stratford, CT (US); Sylvan R. Shemitz, Woodbridge, CT (US)

(73) Assignee: Sylvan R. Shemitz Designs Incorporated, West Haven, CT (US)

( * ) Notice: Subject to any disclaimer, the term of this patent is extended or adjusted under 35 U.S.C. 154(b) by 71 days.

(21) Appl. No.: 11/092,109

(22) Filed: Mar. 29, 2005

(65) Prior Publication Data

US 2005/0213336 A1 Sep. 29, 2005

Related U.S. Application Data

(60) Provisional application No. 60/557,552, filed on Mar. 29, 2004.

(51) Int. Cl.
*F21V 7/09* (2006.01)

(52) U.S. Cl. ..... 362/346; 362/297; 362/347

(58) Field of Classification Search ..... 362/296, 362/297, 298, 343, 346, 347, 348, 350
See application file for complete search history.

(56) References Cited

U.S. PATENT DOCUMENTS

| | | | | |
|---|---|---|---|---|
| 2,717,954 | A * | 9/1955 | Rex | 362/341 |
| 3,679,893 | A | 7/1972 | Shemitz et al. | 240/130 |
| 4,799,136 | A * | 1/1989 | Molnar | 362/347 |
| 5,051,878 | A * | 9/1991 | Ngai | 362/346 |

* cited by examiner

*Primary Examiner*—Y. My Quach-Lee
(74) *Attorney, Agent, or Firm*—Cantor Colburn LLP

(57) ABSTRACT

The present invention may comprise a reflector for a luminaire comprising: a first reflector means; a second reflector means structured as a ballast reflector; a third reflector means; and a fourth reflector means located and structured to reflect light reflected from the first reflector segment; wherein the reflectors precisely direct light into a desired candela distribution for illuminating surfaces evenly at desired angles.

11 Claims, 13 Drawing Sheets

FOUR SEGMENT REFLECTOR

CROSS REFERENCE TO RELATED APPLICATIONS

This application claims priority to U.S. Provisional application No. 60/557,552, filed on Mar. 29, 2004, the entire disclosure of which is incorporated by reference herein.

BACKGROUND OF THE INVENTION

Light fixtures such as fluorescent light fixtures and their associated components may be termed "luminaires" in the art. For example a luminaire may be defined as a complete lighting unit comprising a lamp or lamps together with a housing designed to distribute the light, to position and to protect the lamps, and to connect the lamps to a power supply. Thus, it is common to use a reflector as a component of the luminaire to redistribute the light from the lamps in a desired direction. Parabolic reflectors for example, are widely in luminaires to direct light in a single direction. Elliptical reflectors are also used in luminaires to direct light to a single point. It follows that the chosen shape or contour of the reflector determines in large part the distribution and intensities of reflected light.

Additionally, the formalized study of ornamental lighting and professional lighting design, and the expectation of a typical user, has become more rigorous. For example, when a sign on an office building is illuminated, modern users expect the lighting to be of desired intensity and to be projected onto the target surface accurately and uniformly with minimal spill light and without streaking or intensity lines. Additionally, users do not want to see the lamp itself or the glare from the lamp. Thus, there is a need to rigorously study and further develop shaped reflectors used as luminaires in the art.

The present invention represents at least an improvement over the original Elliptipar™ reflector (U.S. Pat. No. 3,679,893) designed by one of the present applicants. The original reflector design used a single elliptical segment and two parabolic segments. The new design uses four segments including a ballast cover, with multiple sub-segments as described below.

The present invention discloses advantages as compared to the art as described in detail below.

BRIEF SUMMARY OF THE INVENTION

The present invention may comprise a luminaire having a four segment reflector that increases peak illuminance over known reflector designs. The resultant candela distribution curve is smooth which is excellent for uniformly lighting surfaces without inducing streaking or striations.

Thus, the present invention may comprise a reflector for a luminaire comprising: a first reflector means; a second reflector means structured as a ballast reflector; a third reflector means; and a fourth reflector means located and structured to reflect light reflected from the first reflector segment; wherein the reflectors precisely direct light into a desired candela distribution for illuminating surfaces evenly at desired angles.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

BRIEF DESCRIPTION OF THE PREFERRED EMBODIMENTS

Figure 1:
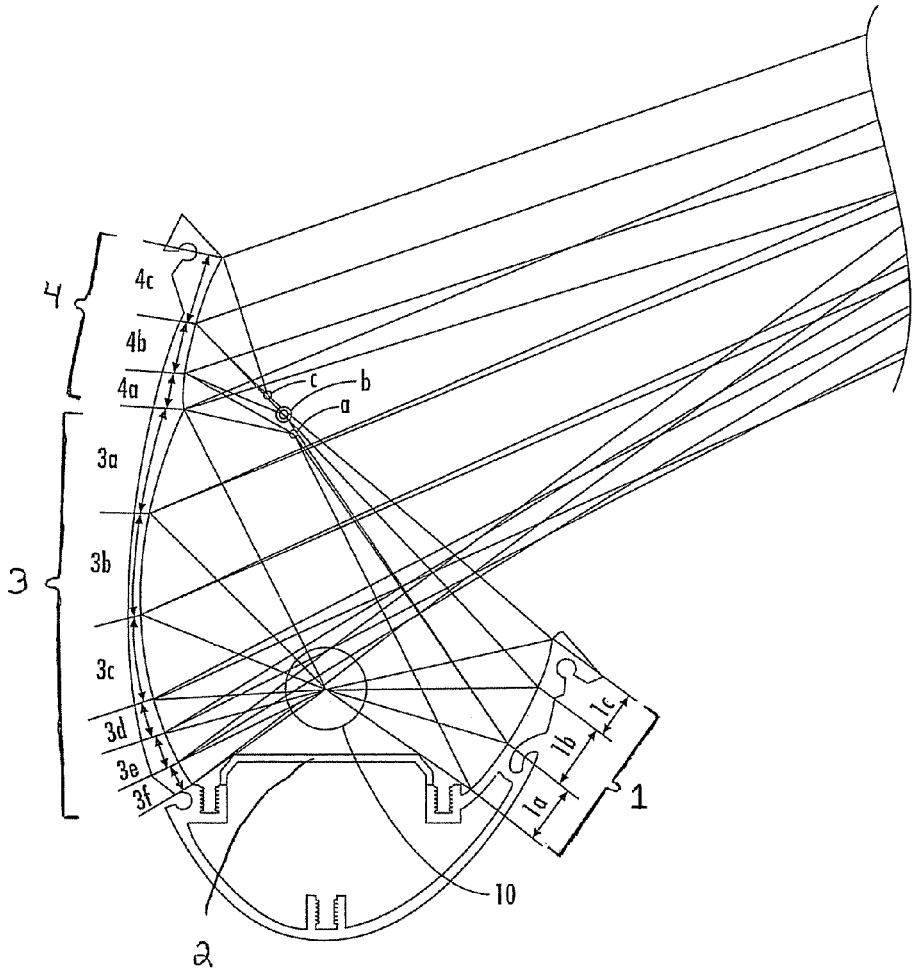
FIGS. 1–5 are profile views of an embodiment of a four segment reflector showing the different segments.
Figure 7:
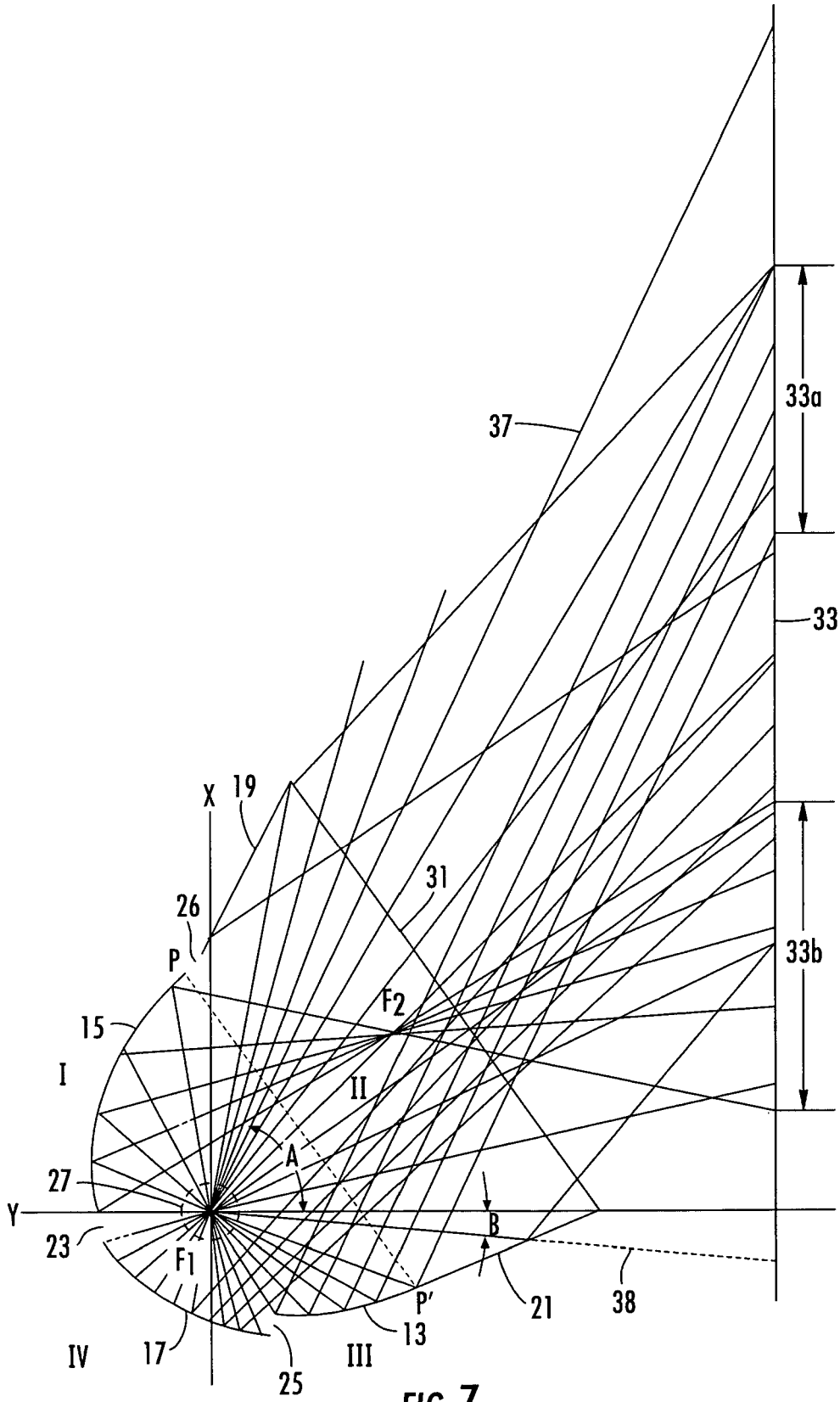
FIG. 7 (PRIOR ART)
FIG. 7. is a prior art device from U.S. Pat. No. 3,679,893.
Figure 8:
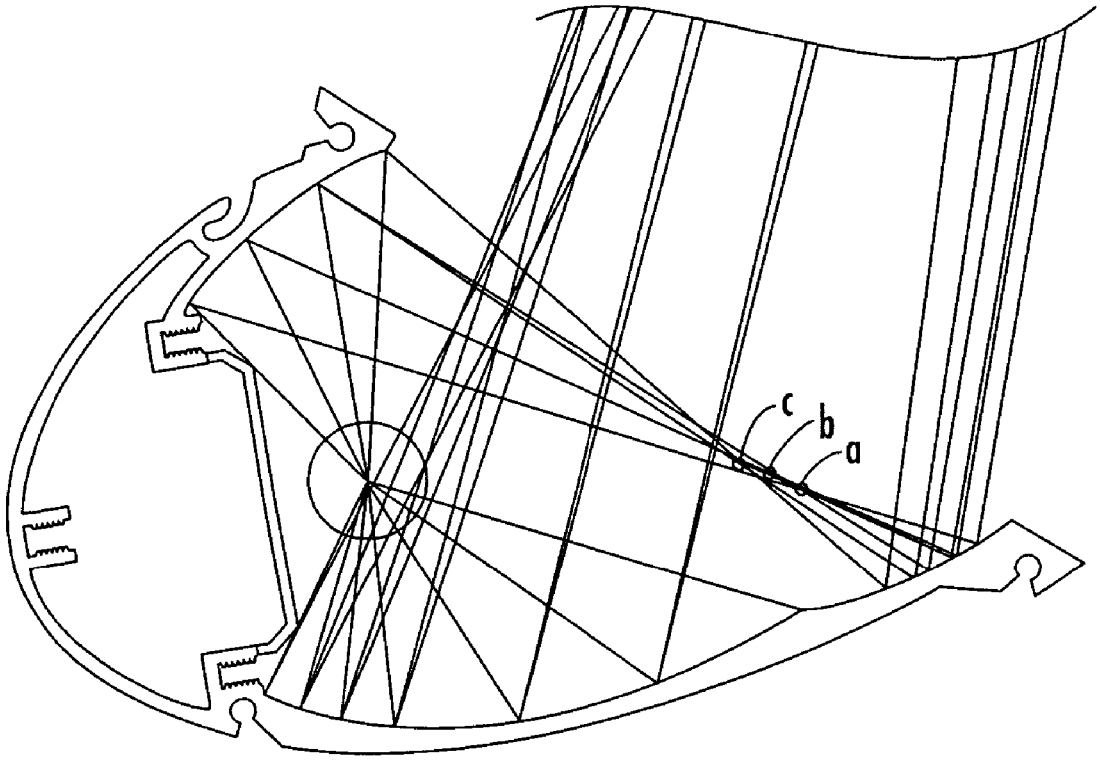
FIG. 8. is a profile view of the embodiment from FIGS. 1–5.

For introduction, a comparison of prior art FIG. 7 to present FIG. 8 shows many of the readily apparent structural differences between the prior art, and the differences in the resultant output beam shape, both of which are discussed in greater detail below. The first difference is that the present reflector has four reflector segments (1–4) with sub-segments (1*a*–1*c*, 3*a*–3*f*, and 4*a*–4*c*) in sections 1, 3, and 4 as shown in FIG. 1. It can be seen that some of these subsegments (1*a*–1*c*) focus light from the lamp 10 to focal points a, b, c for example.

Additionally, section 2 is actually a reflective ballast cover located over the lamp 10. As can be seen in prior art FIG. 7, the prior art device only has simple shaped "non-sub segmented" parabolic and elliptical segments and no ballast cover reflector.

Figure 9:
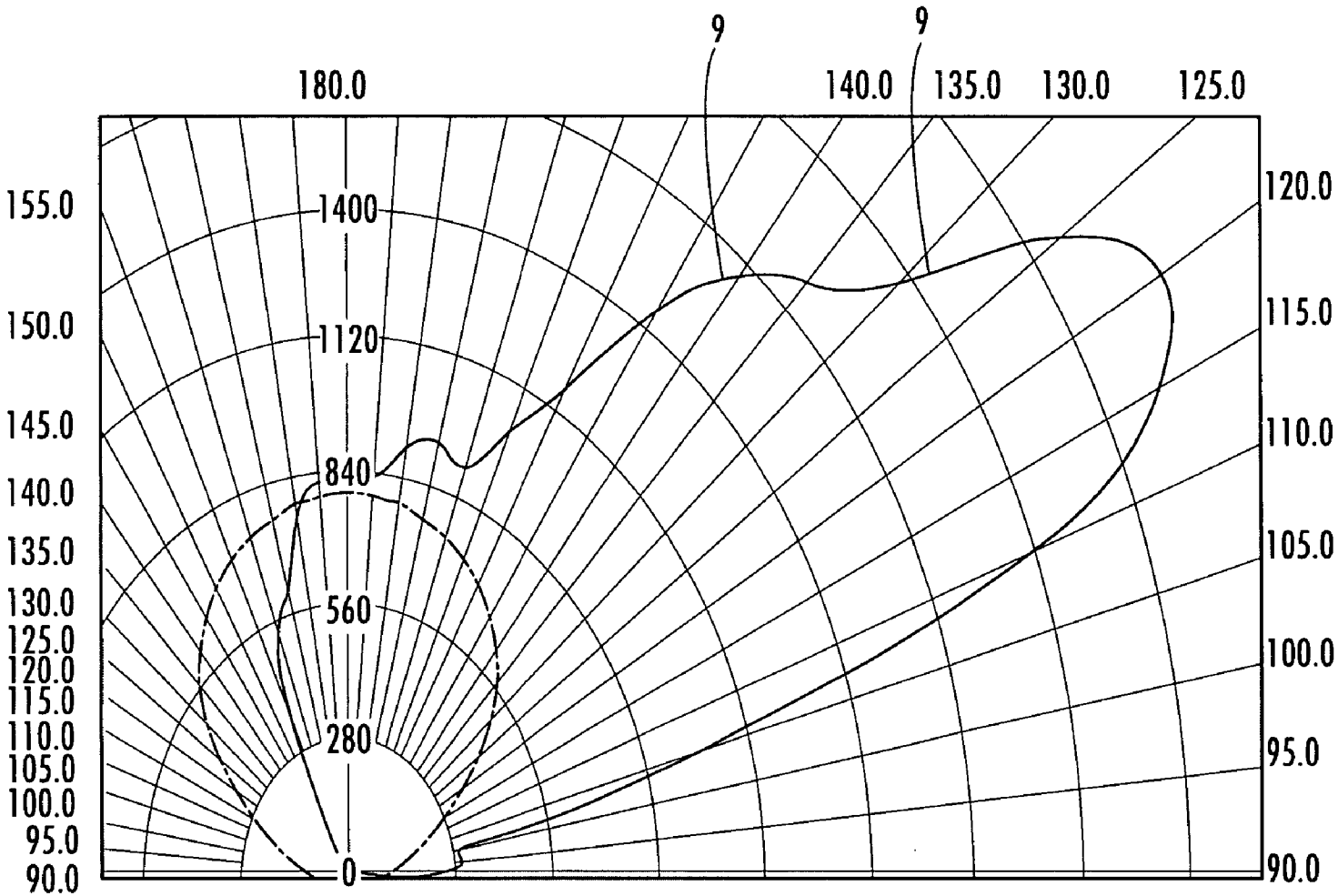
FIG. 9 (PRIOR ART)
FIG. 9 is a prior art candela distribution plot from U.S. Pat. No. 3,679,893.
Figure 10:
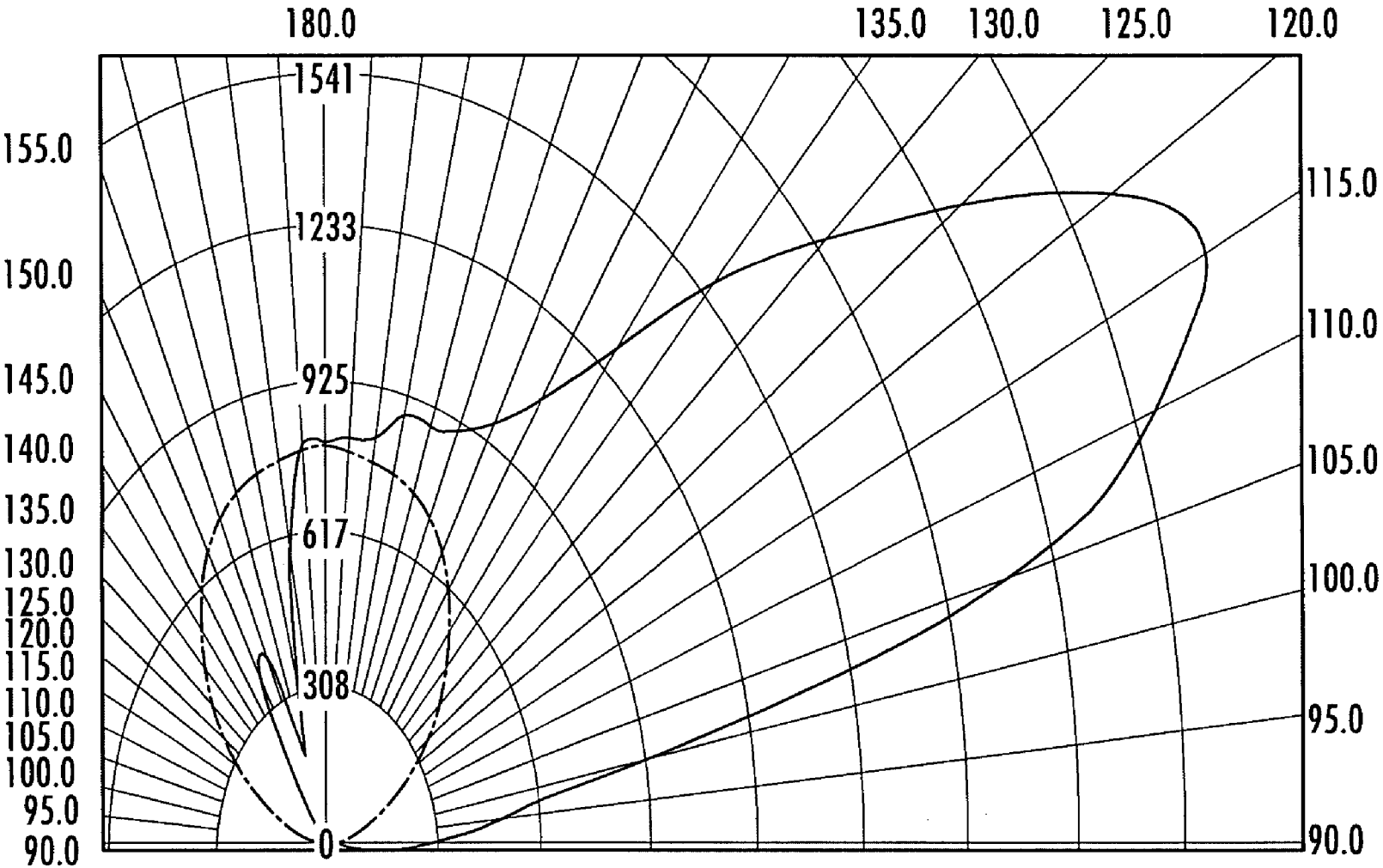
FIG. 10 is a candela distribution plot from the embodiment of FIG. 1–5 and 8.
Figure 11:
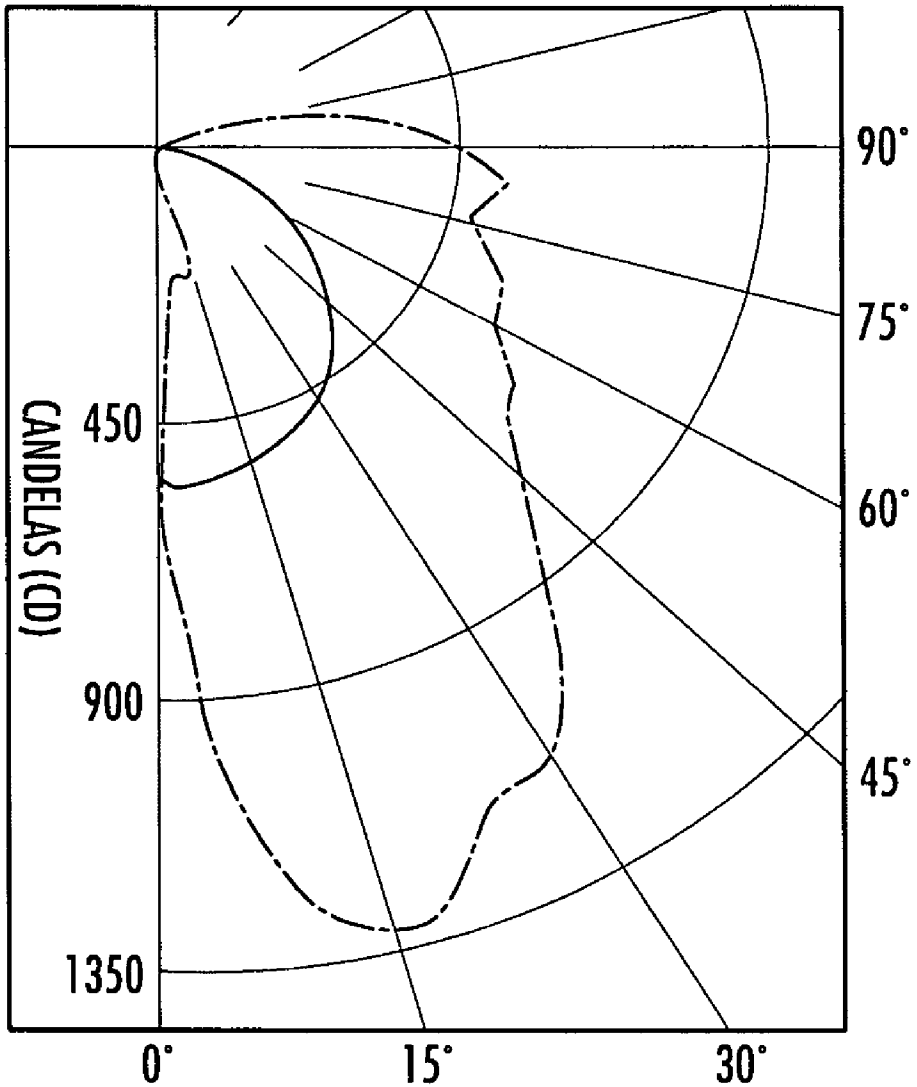
FIG. 11 (PRIOR ART)
FIG. 11 is a photometric measured result from the prior art patent, U.S. Pat. No. 3,679,893.
Figure 12:
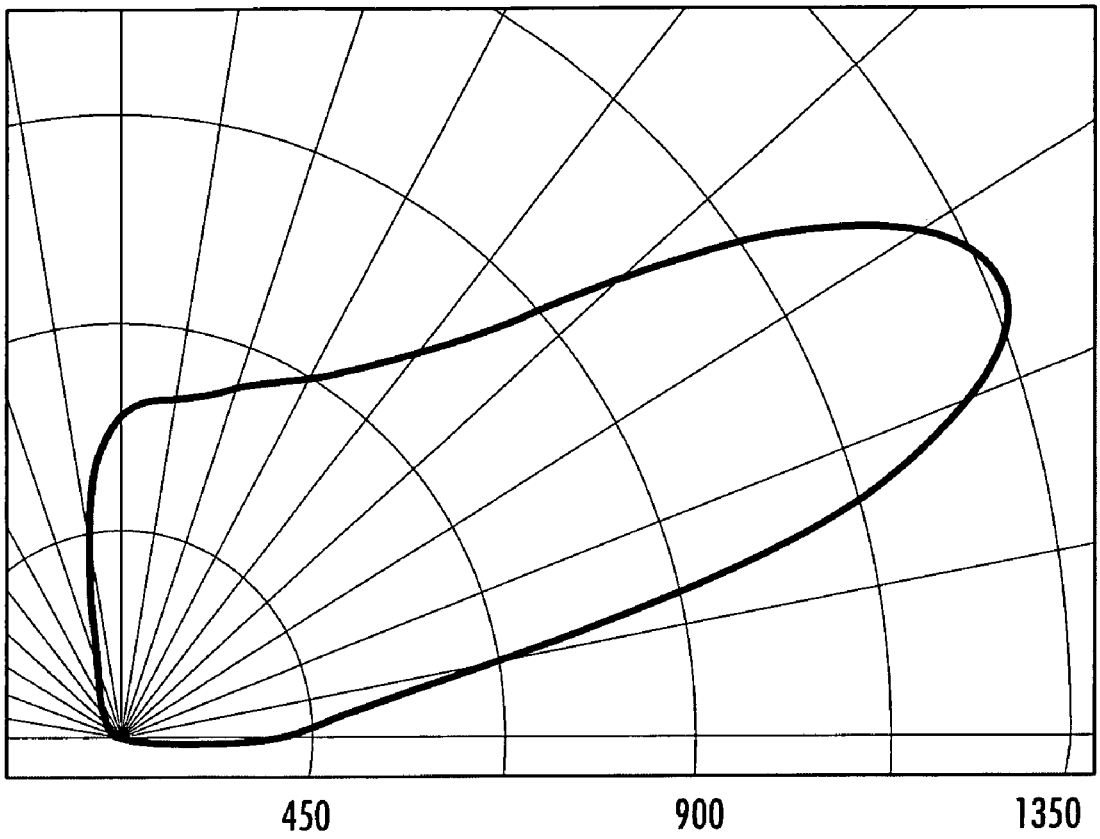
FIG. 12 is a photometric measured result from the embodiment of FIG. 1–5, 8 and 10.

As shown in FIG. 1, the reflector 1 has four reflector sections (1–4) or reflector segments and each of reflector segments 1, and 3–4, is broken into smaller sub-sections or "subsegments" (1*a*–1*c*, 3*a*–3*f*, and 4*a*–4*c*). Each section is discussed in detail below in reference to FIGS. 2–5. Overall, the four reflector sections work in concert to direct the resultant output light only where desired as shown by the ray diagram in FIG. 1. Additionally, the reflector achieves a superior asymmetric candlepower or candela distribution as shown in the polar plot of FIG. 6 when compared to the prior art because it provides a smoother beam by minimizing striations (compare FIGS. 9 and 10 to each other, and also compare FIGS. 11 and 12 to each other, wherein the top of the present plots is smoother, i.e., reduced striations or streaking in the resultant light). Thus, for example, at a desired angle (110 degrees in the example of FIG. 6) above the nadir (0 degrees) the maximum illuminance in candelas (see FIG. 10) can be directed to direct the beam uniformly in a desired direction to form a precise asymmetric or triangular shaped resultant illumination light profile (see FIG. 13). As discussed above, the present resultant candela distribution curve is smooth (compare FIGS. 9 and 10, and also FIGS. 11 and 12 wherein the top of the present plots is smoother) which is excellent for uniformly lighting surfaces, such as ceilings for example without inducing streaking, striations, or intensity lines. In contrast, the prior art candela distribution curve shown in FIGS. 9 and 11 is not as smooth and has bumps (9) or striations forming a striated effect output curve. This results in streaks of light and uneven intensity on the surface.

Figure 2:
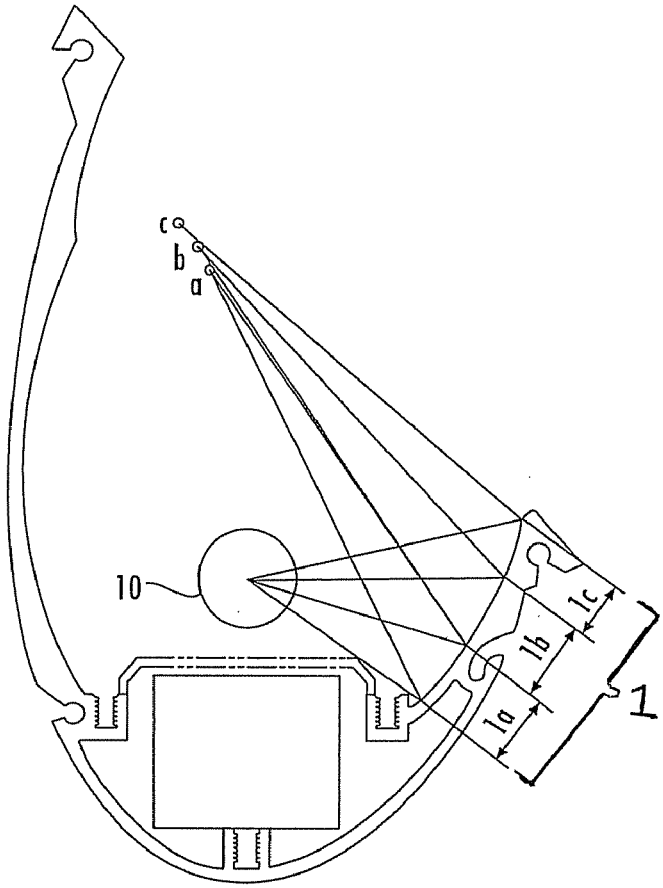
Figure 13:
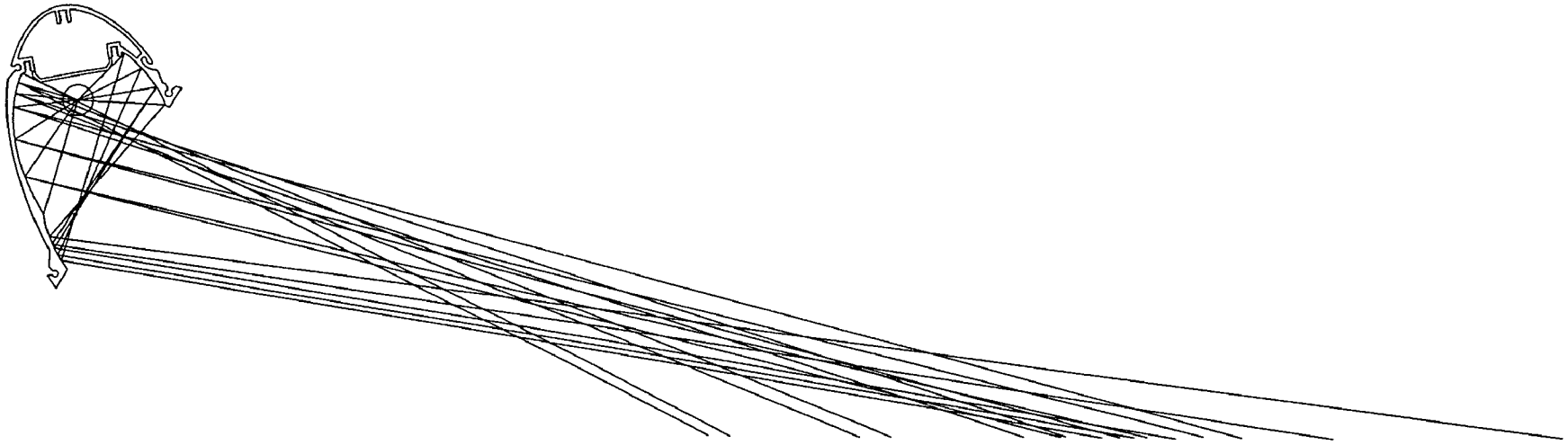
FIG. 13 is exemplary race trace diagram of an embodiment.

Now the specific structure of a preferred embodiment will be discussed. Referring to FIG. 2, the first reflector is shown, elliptical reflector section 1. The purpose of this elliptically shaped reflector section 1 is to reflect light emitted from the side of the lamp 10 that would otherwise go in an undesired direction. For example, as mentioned above, viewers do not desire to see the lamp 10 and the glare that can result from directly viewing the lamp 10. Additionally, for purposes of precise illumination of a target such as a sign, the rays are directed where desired. A comparison of prior art FIG. 7 and to present FIG. 13 shows that a similar structure is not present in the prior art and that the resultant output beam and candela distribution is very different. Thus, elliptical reflector section 1 acts like a wall or extended lip to minimize the view of the lamp 10 from the users line of sight. The elliptical reflector section 1 is preferably made with a specular reflective surface as opposed to a diffuse surface although a diffuse surface could also be used. Additionally, as shown in FIG. 2, there are three sub-sections (1*a*, 1*b*, 1*c*) and each focuses the light from the lamp 10 as shown in FIG. 2 to three specific focal points (a,b,c) as shown by the ray diagram. In this embodiment the sub-sections (1*a*, 1*b*, 1*c*) are each elliptically shaped sections. Other shapes are contemplated as well for the segments and subsegments.

Figure 3:
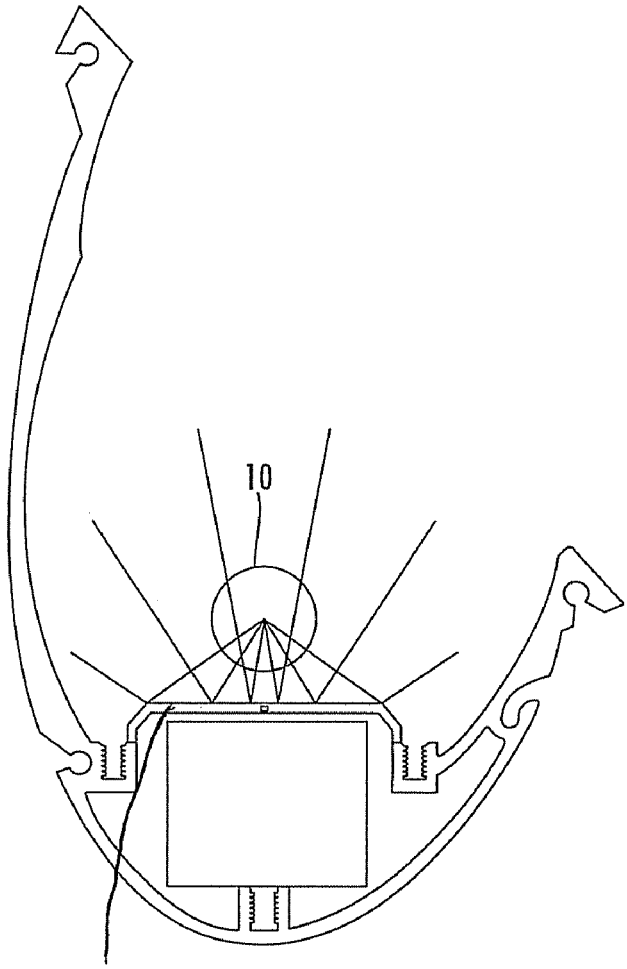

Referring to FIG. 3, the second reflector is shown, ballast cover reflector 2. As can be seen in FIG. 7 which shows the design from prior art U.S. Pat. No. 3,679,893, no such ballast cover reflector is included in the prior art patent. The purpose of the present embodiment second reflector section is to reflect light outward from underneath the lamp in a diffuse manner. Therefore, the ballast reflector cover 2 is preferably made of a matte or diffuse finish. This section is not preferably made of multiple segments, but it is preferably one flat section. The section may also be curved so long as it is not specular. This surface is preferably a highly reflective matte surface, for example painted white The reason this surface is preferably matte and not specular is that a specular surface would create a second image of the light source, lamp 10, and create an undesirable resultant candlepower distribution.

Figure 4:
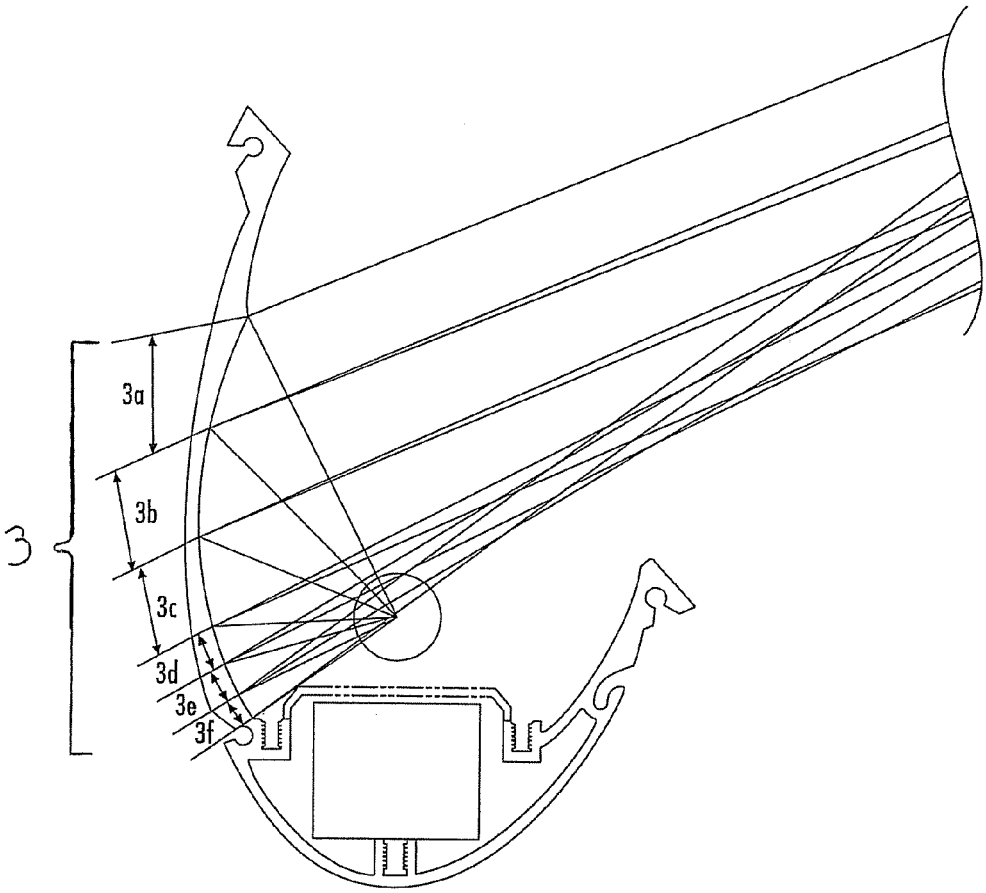

Referring to FIG. 4, this third section termed first parabolic section 3, produces the main light output from the system. It is broken into six sub-sections (3*a*, 3*b*, 3*c*, 3*d*, 3*e*, 3*f*) which are aimed across at the target surface (e.g., wall, ceiling, etc.). As the sub-section surfaces are able to substantially "see" over the lamp, they are directed at lower and lower angles to produce high peak candlepower and fast runback.

Figure 5:
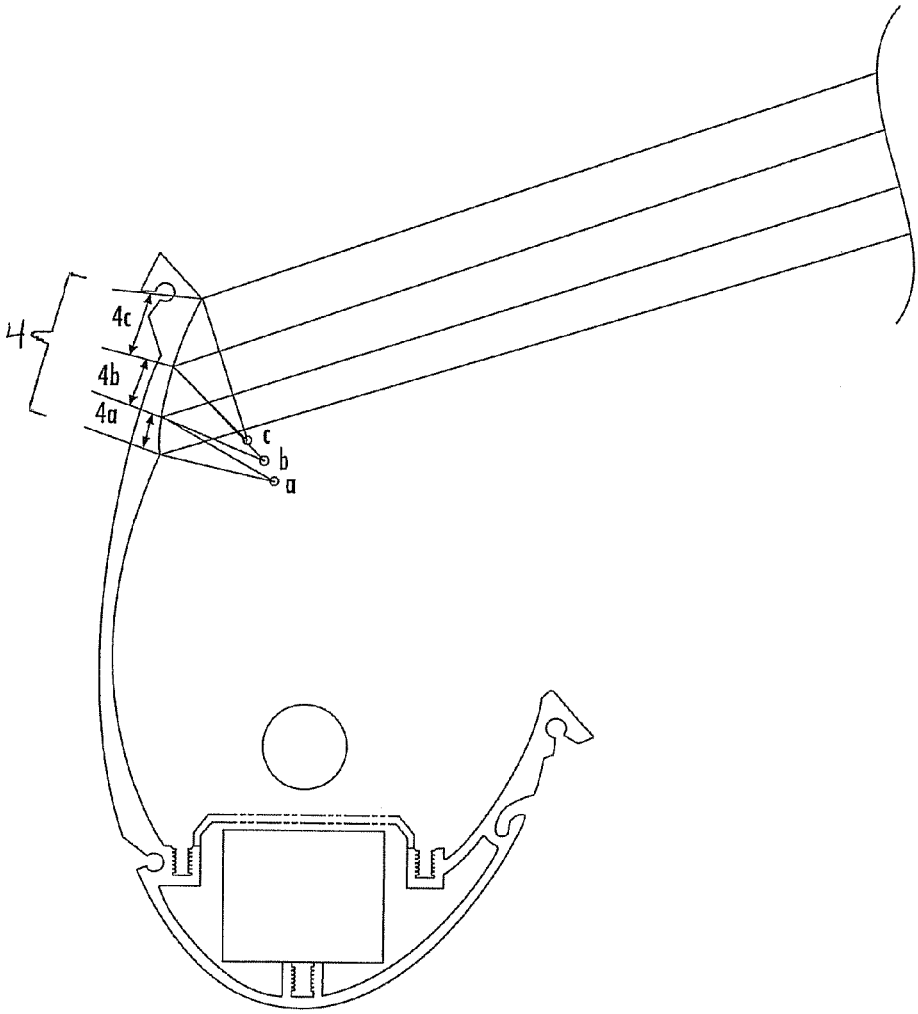

Referring to FIG. 5, light reflected from the elliptical reflector section 1 which would otherwise be incident upon an observer's eyes is reflected and directed to second parabolic section 4 and is subsequently reflected out across the target surface to reinforce the asymmetric light pattern propagated from first parabolic section 3 as shown in the ray diagram of FIG. 1 by sub sections (4*a*, 4*b*, and 4*c*).

Figure 6:
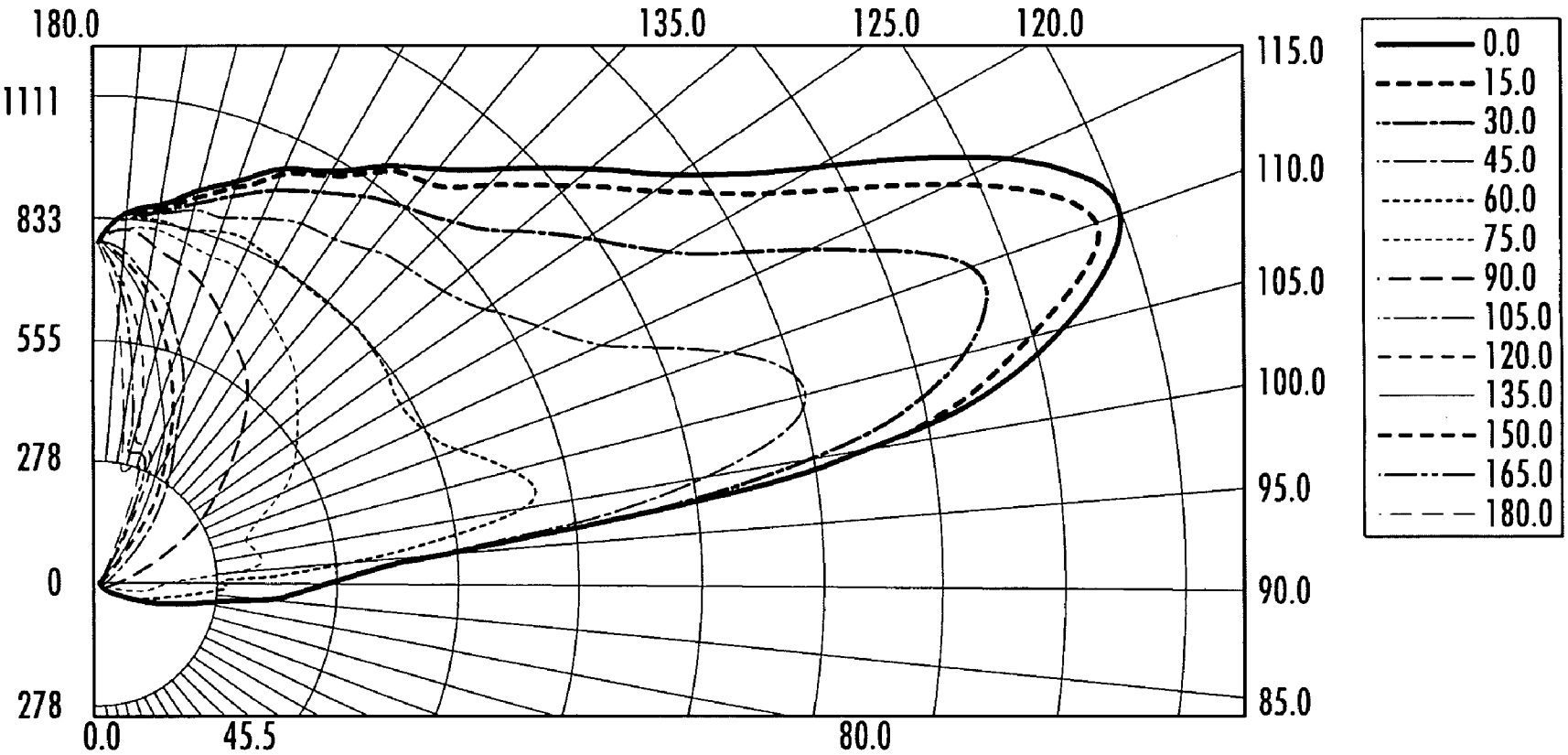
FIG. 6 is a polar plot of candlepower or candela distribution of light from the reflector of FIGS. 1–4.

The resulting candlepower illuminance distribution in candelas, shown in FIG. 6, is has an increase in peak candlepower and increase in energy efficiency over a known three segment reflector design of U.S. Pat. No. 3,679,893. For example in tests it was shown that peak candlepower using a 54W T5/HO lamp is 2520 cd for the prior art whereas peak candlepower using a 54W T5/HO lamp is 2774 cd (about 10% higher) for this specific embodiment of the present invention. Additionally, streaking was mitigated and a more even illumination was resultant. Performance may vary and the different embodiments with different shapes are also contemplated so this data is for purposes of example only and should not be considered to be limiting.

This increase in performance is due part to the present structure minimizing the effects of the inverse square law which dictates that candle power decreases at a much greater rate as it propagates further from the lamp source.

To summarize, an embodiment may comprise a reflector for a luminaire comprising: a first reflector segment located near an opening on the luminaire; a second reflector segment structured as a ballast reflector; a third reflector segment located in the rear of the luminaire; and a fourth reflector segment located and structured to reflect light reflected from the first reflector segment. The reflector may also comprise an embodiment wherein the first reflector segment, the third reflector segment, and the fourth reflector segment comprise sub-segments which precisely direct light into a desired candela distribution for illuminating surfaces evenly at desired angles. The reflector may also comprise an embodiment wherein the first reflector segment comprises three sub-segments which focus light to three focal points. The reflector may also comprise an embodiment wherein the fourth reflector segment comprises 3 sub-segments with focal points coincident to the focal points of the first reflector segment and wherein the fourth reflector segment reflects light from the focal points in substantially parallel rays. An embodiment of the reflector may also comprise an embodiment wherein the third reflective segment comprises multiple sub-segments all sharing a common focal point coincident with a light source of the luminaire and wherein each sub-segment reflects and redirects light from the light source substantially back around the light source so that the light is directed substantially parallel to light reflected from the fourth reflective segment to further reinforce the peak candlepower. The reflector may also comprise an embodiment wherein the second reflective section has a matte finish and reflects the light energy from the source in a lambertian distribution so as not to create a second "false" image of the light source in the other reflector segments. The reflector may also comprise an embodiment wherein the three sub-segments which focus light to three focal points are each elliptical shaped. The reflector may also comprise a first elliptical shaped reflector segment located near an opening on the luminaire; a second flat and diffuse reflector segment structured as a ballast reflector; a third parabolic shaped reflector segment located in the rear of the luminaire; and a fourth parabolic shaped reflector segment located and structured to reflect light reflected from the first reflector segment; wherein the reflectors precisely direct light into a desired candela distribution for illuminating surfaces evenly at desired angles. The reflector may also comprise a luminaire comprise a first reflector means; a second reflector means structured as a ballast reflector; a third reflector means; and a fourth reflector means located and structured to reflect light reflected from the first reflector segment; wherein the reflectors precisely direct light into a desired candela distribution for illuminating surfaces evenly at desired angles.

Thus, it is seen that a four segment reflector and luminaire are presented. One skilled in the art will appreciate that the invention can be practiced by other than the described embodiments, which are presented for purposes of illustration and not of limitations.

What is claimed is:

1. A reflector for a luminaire comprising:

a first reflector segment located near an opening on the luminaire;

a second reflector segment structured as a ballast reflector;

a third reflector segment located in the rear of the luminaire; and a fourth reflector segment located and structured to reflect light reflected from the first reflector segment;

wherein the first reflector segment and the fourth reflector segment each comprise sub-segments which precisely direct light into a desired candela distribution for illuminating surfaces evenly at desired angles; and wherein each of the sub-segments of the fourth reflector segment has a focal point coincident to a focal point of a corresponding sub-segment of the first reflector segment.

2. The reflector of claim 1 wherein, the third reflector segment comprises sub-segments which precisely direct light into a desired candela distribution for illuminating surfaces evenly at desired angles.

3. The reflector of claim 1 wherein the first reflector segment comprises three sub-segments which focus light to three focal points.

4. The reflector of claim 3 wherein the three sub-segments which focus light to three focal points are each elliptical shaped.

5. The reflector of claim 1, wherein the fourth reflector segment comprises 3 sub-segments with focal points coincident to the focal points of the first reflector segment and wherein the fourth reflector segment reflects light from the focal points in substantially parallel rays.

6. The reflector as in claim 1 wherein the third reflector segment comprises multiple sub-segments all sharing a common focal point coincident with a light source of the luminaire and wherein each sub-segment reflects and redirects light from the light source substantially back around the light source so that the light is directed substantially parallel to light reflected from the fourth reflector segment to further reinforce the peak candlepower.

7. The reflector of claim 1 wherein the second reflector segment has a matte finish and reflects the light energy from a light source in a lambertian distribution so as not to create a second "false" image of the light source in the other reflector segments.

8. The reflector for a luminaire comprising of claim 1, wherein:

the first reflector segment is elliptical shaped;

the second reflector segment is a flat and diffuse reflector;

the third reflector segment is shaped; and the fourth reflector segment is parabolic shaped.

9. A reflector for a luminaire comprising:

a first reflector segment located near an opening on the luminaire;

a second reflector segment structured as a ballast reflector;

a third reflector segment located in the rear of the luminaire; and a fourth reflector segment located and structured to reflect light reflected from the first reflector segment;

wherein the first reflector segment comprises three sub-segments which focus light to three focal points.

10. The reflector for a luminaire of claim 9, wherein the three sub-segments which focus light to three focal points are each elliptical shaped.

11. A reflector for a luminaire comprising:

a first reflector segment located near an opening on the luininaire;

a second reflector segment structured as a ballast reflector;

a third reflector segment located in the rear of the luminaire; and a fourth reflector segment located and structured to reflect light reflected from the first reflector segment;

wherein the third reflector segment comprises multiple sub-segments all sharing a common focal point coincident with a light source of the luminaire and wherein each sub-segment reflects and redirects light from the light source substantially back around the light source so that the light is directed substantially parallel to light reflected from the fourth reflector segment to further reinforce the peak candlepower.

* * * * *